United States Patent [19]

Giese et al.

[11] Patent Number: 4,777,738

[45] Date of Patent: Oct. 18, 1988

[54] SLIP-RESISTANT SOLE

[75] Inventors: Erik O. Giese, Key Biscayne, Fla.; Roger J. Brown, Aspen, Colo.

[73] Assignee: The Stride Rite Corporation, Cambridge, Mass.

[21] Appl. No.: 894,751

[22] Filed: Aug. 12, 1986

Related U.S. Application Data

[63] Continuation of Ser. No. 612,050, May 18, 1984.

[51] Int. Cl.[4] ..... A43B 5/06; A43B 5/00

[52] U.S. Cl. ..... 36/32 R; 36/59 C; 36/116; D2/320

[58] Field of Search ..... 36/32 R, 59 C, 114, 36/30 A, 31, 116, 113, 25 R; D2/308, 309, 310, 274, 320

[56] References Cited

U.S. PATENT DOCUMENTS

| | | | |
|---|---|---|---|
| D. 76,541 | 10/1928 | Hopwood | D2/320 |
| D. 81,438 | 6/1930 | Ferrettie et al. . | |
| D. 117,585 | 11/1939 | Sperry . | |
| D. 136,381 | 9/1943 | Ghez et al. . | |
| D. 164,095 | 7/1951 | Bovay | D2/320 |
| D. 213,417 | 3/1969 | Dittmar | D2/320 |
| D. 255,175 | 6/1980 | Iwakata | D2/320 |
| D. 266,797 | 11/1982 | Lucarelli et al. | D2/320 |
| D. 275,148 | 8/1984 | Bergmans | D2/320 |
| D. 278,851 | 5/1985 | Austin | D2/320 |
| D. 285,985 | 10/1986 | Tong | D2/320 |
| 296,519 | 4/1884 | Brooks . | |
| 299,840 | 6/1884 | Norman . | |
| 485,459 | 11/1892 | Crocker . | |
| 495,131 | 4/1893 | Guice . | |
| 1,524,782 | 2/1925 | Clarke . | |
| 1,528,782 | 3/1925 | Perry . | |
| 1,680,147 | 8/1928 | Gilowitz . | |
| 2,124,986 | 7/1938 | Pipes | 36/59 C |
| 2,155,166 | 4/1939 | Kraft | 36/59 |
| 2,205,912 | 6/1940 | Snyder | 36/59 |
| 2,206,860 | 7/1940 | Sperry | 36/59 |
| 2,229,406 | 1/1941 | Cutler | 36/59 |
| 2,236,278 | 3/1941 | Tousley | 36/59 |
| 2,370,301 | 2/1945 | Ghez et al. | 36/33 |
| 2,394,454 | 2/1946 | Kappeler | 36/59 |
| 2,408,214 | 9/1946 | Husted | 36/59 |
| 2,833,057 | 5/1958 | Hack | 36/59 |
| 3,824,716 | 7/1974 | DiPaolo | 36/32 |
| 3,875,689 | 4/1975 | Tomas | 36/32 |
| 4,141,158 | 2/1979 | Benseler et al. | 36/32 |
| 4,241,524 | 12/1980 | Sink | 36/102 |
| 4,266,349 | 5/1981 | Schmohl | 36/59 C |
| 4,281,467 | 8/1981 | Anderie | 36/32 |
| 4,316,335 | 2/1982 | Giese et al. | 36/59 R |
| 4,364,188 | 12/1982 | Turner et al. | 36/31 |
| 4,364,190 | 12/1982 | Yonkers | 36/32 |
| 4,378,641 | 4/1983 | Tarlow | 36/32 |
| 4,570,362 | 2/1986 | Vermonet | 36/59 C |

FOREIGN PATENT DOCUMENTS

| | | | |
|---|---|---|---|
| 1018202 | 12/1952 | France | 36/59 R |
| 1158294 | 6/1958 | France . | |
| 2148347 | 3/1973 | France . | |
| 2284289 | 4/1976 | France . | |
| 2434587 | 3/1980 | France . | |
| 252336 | 9/1948 | Switzerland | 36/59 C |
| 471179 | 8/1937 | United Kingdom | 36/59 C |
| 848877 | 9/1960 | United Kingdom | 36/59 C |

*Primary Examiner*—Steven N. Meyers

[57] ABSTRACT

A slip-resistant shoe sole comprising an outsole layer having a bottom surface defining a region of contact between the sole and the ground, the outsole layer bearing a plurality of channels opening onto the bottom surface to define a pattern of elongated gaps across the contact region, the ratio of the area of the gaps to the surface area of the contact region and the configuration of the gaps being arranged to effectively cause liquid between the contact region and the ground to be conducted away while enhancing the slip resistance produced by the contact region engaging the ground.

29 Claims, 2 Drawing Sheets

FIG 1
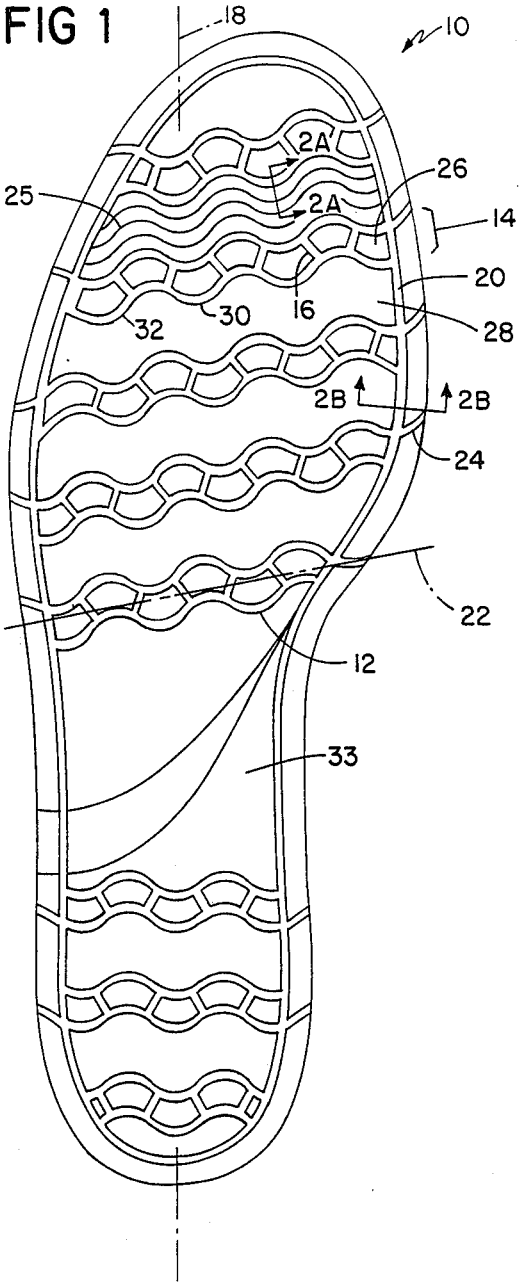
FIG 3
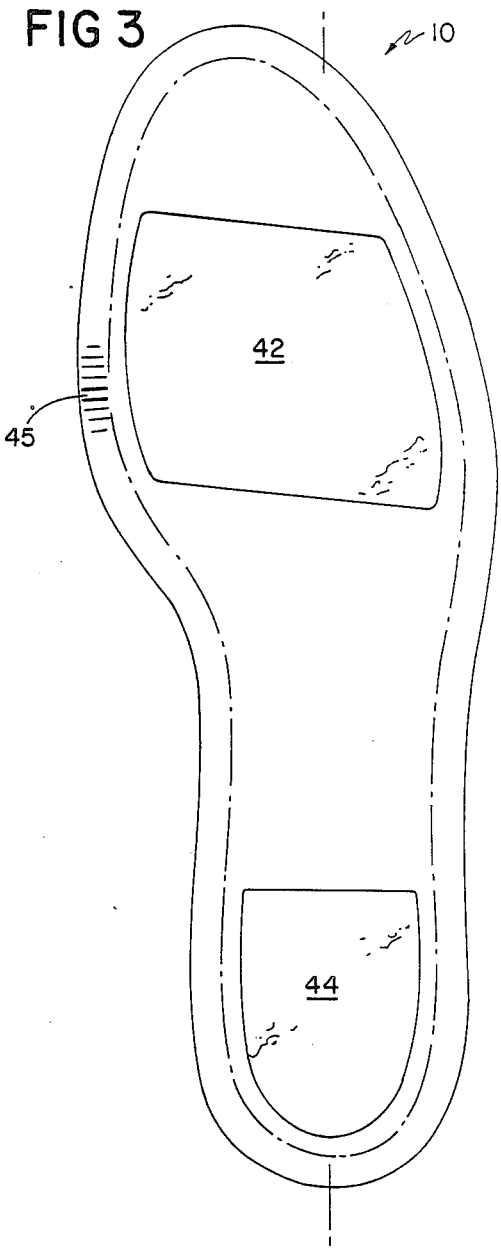
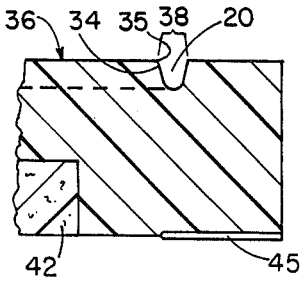
FIG 2B
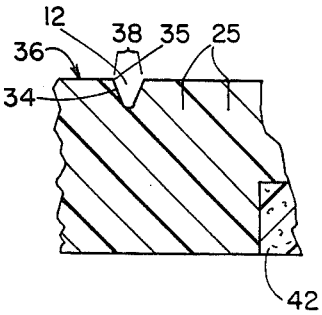
FIG 2A

SLIP-RESISTANT SOLE

This is a contiuation, of application Ser. No. 612,050, filed May 18, 1984.

BACKGROUND OF THE INVENTION

The invention relates to slip-resistant shoe soles.

Slip resistance can be improved by special tread patterns in the bottom surface of the outsole, and by siping the bottom of the outsole (i.e., incising parallel wavy cuts).

SUMMARY OF THE INVENTION

In general, the invention features a slip-resistant shoe sole comprising an outsole layer having a bottom surface defining a region of contact between the sole and the ground, the outsole layer bearing a plurality of channels opening onto the bottom surface to define a pattern of elongated gaps across the contact region, the ratio of the area of the gaps to the surface area of the contact region and the configuration of the gaps being arranged to effectively cause liquid between the contact region and the ground to be conducted away, while enhancing the slip resistance produced by the contact region engaging the ground.

In preferred embodiments, the outsole layer bears a plurality of siping slits (preferably only in the toe area); the ratio of the area of the gaps to the surface area of the contact region is no less than 10% and no more than 40%; each gap is no less than 1/16" wide; each gap is bounded by wiping edges where walls of the channel meet the bottom surface, the wiping edges being contoured to include sections perpendicular to a longitudinal axis of the sole and sections at oblique angles to the longitudinal axis, whereby liquid between the contact region and the ground is effectively forced into the channels and conducted to the perimeter of the sole, enhancing the slip resistance produced by the contact region engaging the ground at an angle of attack either along or oblique to the longitudinal axis; the portions of the contact region between the elongated gaps include friction pads no shorter than 3/16" (preferably ¼") in their shortest dimension and no longer than 0.60" in their longest dimension; each channel has walls which meet the contact region at an angle greater than 105° (preferably 110°); the friction pads include friction bars which run transversely across the sole and bear siping slits to improve slip resistance; each friction bar is at least ⅜" (preferably ½") and no more than 0.60" in the longitudinal dimension, and bears at least two siping slits; the channels include a plurality of parallel transverse wavy grooves spaced apart along the length of the contact region, the wavy grooves are paired, the grooves of each pair are connected by a plurality of straight grooves to define a sequence of friction pads between the grooves of each pair, and successive pairs of the grooves are separated by friction bars which run substantially uninterrupted transversely across the bottom surface of the outsole layer; at least some of the elongated gaps are arranged in a pattern of concentric arcs centered on a point in the ball area, and adjacent elongated gaps are connected by straight gaps oriented along radii of the pattern; the sole includes shock foam inserts in the ball and heel areas; the sole includes siping (three parallel wavy cuts undulating the same as the wavy grooves) on at least some of the friction bars; and the contact region is flat.

The grooves conduct liquid toward the shoe perimeter (i.e., away from weight-bearing and contact surfaces), and the siping aids by wiping the contact surface, thus improving the friction between the contact region and the ground and reducing slipping and hydroplaning. The wiping edges enhance the wiping of liquid into the grooves. The contour of the wiping edges assures that wiping will occur even when the shoe strikes the ground in directions oblique to the longitudinal axis of the sole. The void-to-contact ratio of gap area to contact area enhances both the conducting of liquid away from the shoe and the frictional slip-resistance of the contact region against the ground. The size of the channels assures adequate space for the conducting of liquid, and the angle of the channel walls minimizes the accumulation of small objects in the channels. The large angle between the channel walls and the contact region (i.e., the high draft of the channels) aids in ejecting foreign objects. The sizes of the friction pads aid in their flexibility, and enable the friction pads to move independently of each other to provide good contact with the ground even during unusual foot movements or uneven weight distribution, e.g., movements on boat decks. The friction pads and bars are large enough to reduce the likelihood of damage to them. In embodiments having grooves in a concentric arc pattern in the ball area, the sole effectively grinds particles, e.g., food, lying on the ground, thus reducing the likelihood of the user slipping. The shock foam inserts reduce shock to the user's foot, and provide more uniformity of pressure distribution to the bottom of the outsole. The flatness of the contact region improves the slip resistance.

Other advantages and features will become apparent from the following description of the preferred embodiments and from the claims.

DESCRIPTION OF THE PREFERRED EMBODIMENTS

Drawings

FIG. 1 is a bottom view of a shoe sole according to the preferred embodiment;

FIGS. 2*a*, 2*b* are cross-sectional views taken at 2*a*–2*a* and 2*b*–2*b* of FIG. 1 and showing respectively the wavy grooves and the Littleway groove in the preferred embodiment;

FIG. 3 is a top view of the preferred embodiment;

STRUCTURE

Figure 4:
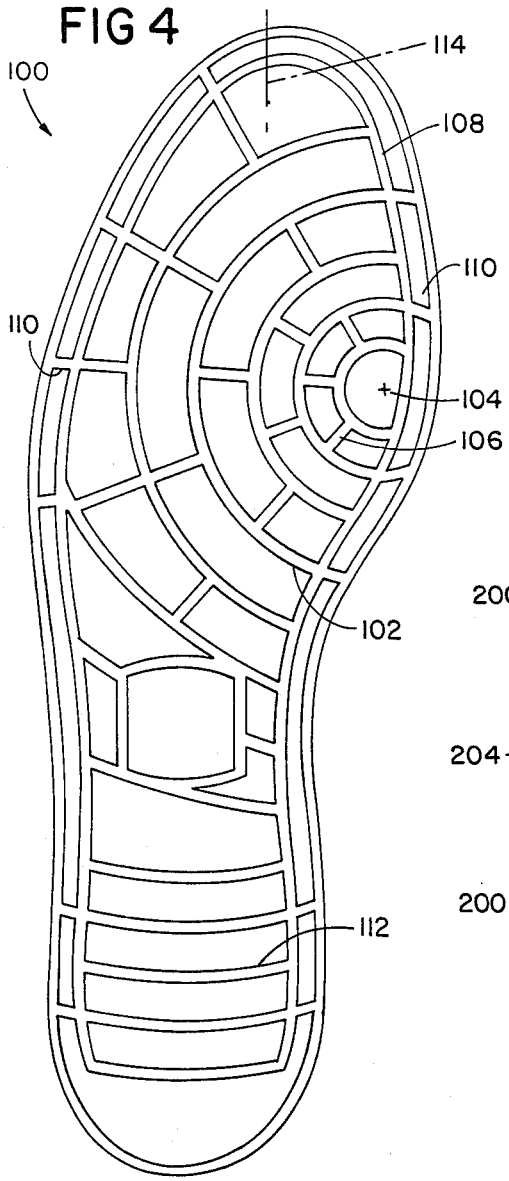
FIG. 4 is a bottom view of an alternate embodiment.

Referring to FIG. 1, the bottom surface of outsole 10 (men's size 10) has a tread pattern with sixteen transverse wavy grooves (or channels) 12 on the toe and heel areas. Grooves 12 are arranged in pairs 14 (that define transverse regions), with the grooves of each pair connected by short straight grooves 16 (interconnection grooves or channels) each of which is oriented perpendicular to the two grooves of the pair and oblique to the longitudinal axis 18 of outsole 10. Each groove pair 14 extends from one side to the other side of outsole 10 in a region outlined by Littleway stitching groove (peripheral groove) 20 which follows along the perimeter (peripheral edge) of outsole 10. In the toe area, the axis 22 of each groove pair 14 is oriented at an 80° angle to axis 18. In the heel area, each groove pair 14 is oriented perpendicular to axis 18. In each groove pair 14 (except for the rearmost pair), one of the grooves 12 has an extension 24 which passes beyond Littleway groove 20 to the very edge of outsole 10. Within each groove pair 14, a row of friction pads 26 (a type of friction element) is defined by grooves 12, 16. Each friction pad is no shorter than 3/16", and no longer than 0.60", preferably ¼", long (i.e., in the direction of the longitudinal axis 18). Between adjacent groove pairs 14 are friction bars 28 (another type of friction element), each of which is at least ⅜", and no longer than 0.60", preferably ½", long (in the direction of longitudinal axis 18). Each friction bar 28 in the toe area bears a siping pattern 29 of three wavy cuts which undulate like grooves 12 (in FIG. 1, the siping is only shown on one of the frictions bars). Each groove 12, by virtue of its wavy contour, has some sections which are perpendicular to axis 18 and other sections which are at various oblique angles to axis 18.

The heel portion of outsole 10 extends forward into the medial region to define an arch support 33.

Referring to FIGS. 2*a*, 2*b*, grooves 12, 16, 20 are 0.080" deep v-shaped channels whose side walls 34 meet the bottom surface 36 of outsole 10 at an angle of at least 105° (preferably 110°). The corners where side walls 34 meet bottom surface 36 form wiping edges 35. Each groove 12, 16 thus forms a gap 38 of no less than 1/16" (preferably 0.080") in bottom surface 36.

The void-to-contact ratio of the contact region of the ball and heel areas (i.e., the ratio of the area represented by gaps 38 to the aggregate area of contact between the ball and heel areas and the ground) is between about 10% and about 40%, preferably about 20%.

Outsole 10 is molded of rubber (available under the name Sperry compound from Goodyear Tire & Rubber Company) having a durometer of 60–65 shore A. Outsole 10 is molded with the bottom surface 36 as flat as possible, minimizing doming or curving, to increase the contact area.

Referring to FIG. 3, outsole 10 is molded with recesses in its upper surface to receive shock foam inserts 42, 44 in the toe and heel areas respectively. The edges of the recesses are 0.520" from the perimeter of outsole 10. Inserts 42, 44 are respectively 0.20" thick and 0.40" thick and are molded of shock attenuating foam (e.g., EVA, Sportcell, or cushion crepe). The perimeter of outsole 10 is marked by wheeling 45.

Operation

When outsole 10 strikes a wet ground surface, the wiping edges 35 wipe the liquid into grooves 12, 16, 20, which then conduct the liquid to the perimeter of the outsole. Extensions 24 further conduct the liquid away from the outsole. The pressure between the ground and friction pads and bars 26, 28 also forces the liquid into grooves 12, 16, 20. The siping aids in the wiping of the ground surface. The ground is left drier allowing the pads and bars 26, 28 to effectively grab the ground surface. These effects occur whether the outsole strikes the ground surface in the direction of longitudinal axis 18 or obliquely to the axis. The ratio of gap area to contact area (void-to-contact ratio) in the range between 10% and 40% maximizes both the conducting of liquid away from the shoe and the frictional slip-resistance of the contact region against the ground. Pebbles or other objects are not caught in the grooves because the grooves are relatively open. The sizes of the friction pads promote their flexibility which enhances friction and enables them to flex independently, while reducing the likelihood of damage to them.

In one test of the coefficient of friction of an outsole like that of FIG. 1 (but having two siping cuts per friction bar rather than three), a resin surface, simulating a fiberglass boat deck, was flooded with water and the sole (which was pressed against the resin surface by weights) was caused to slide both along the longitudinal axis of the outsole and in directions oblique to the longitudinal axis. The measured peak dynamic coefficient of friction was 1.5, and the average dynamic coefficient of friction was 0.9+.

Figure 5:
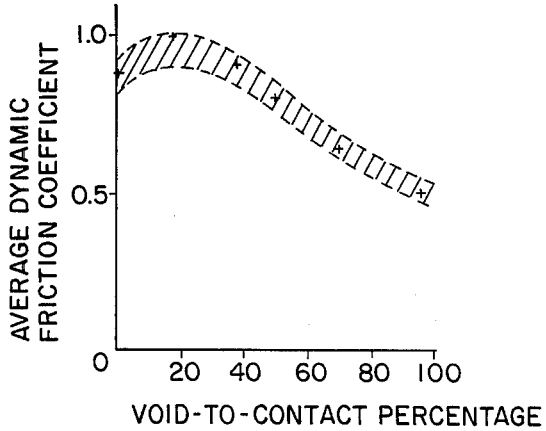
FIG. 5 is a bottom view showing representative alternative siping patterns.

Referring to FIG. 5, the tested average dynamic friction coefficients of various outsoles (including an outsole in accordance with the invention and other outsoles) having different void-to-contact percentages are shown. Each "+" indicates the average coefficient for a particular sole pattern. The test involved weighting the outsole with a 120 lb. load and sliding it across a wet surface. The results reflect an average of five trials. The range of results among the five trials is represented by the shaded band. The highest dynamic friction coefficients occurred with void-to-contact percentages in the range of 10% to 40%, preferably 20%.

Alternate Embodiments

Referring to FIG. 4, in other embodiments outsole 100 (for use by restaurant employees) has a tread pattern of grooves 102.

In the toe area, there are six concentric arc-shaped grooves 102 (for men's size 10) centered on a point 104 near the inside edge of the toe area. Adjacent arc-shaped grooves are separated by successively greater intervals at greater distances from point 104. Adjacent arc-shaped grooves 102 are connected by short straight grooves 106 which are aligned on radii centered at point 104. Littleway groove 108 follows along the perimeter of outsole 10. Extensions 110 of some of the arc-shaped grooves, and of some of the short straight grooves, extend beyond Littleway groove 108 to the edge of outsole 110.

In the heel area are five arc-shaped grooves 112 which are generally perpendicular to the longitudinal axis 114 of outsole 100 and extend from side to side in the region outlined by Littleway groove 108. Two of the grooves 112 extend beyond Littleway groove 108 to the edge of outsole 100.

Grooves 102, 108 and extensions 110 are 0.090" deep v-shaped channels which form gaps of 0.110" in the bottom surface of outsole 100. Each channel has a bottom radius of 0.04" to 0.06". The side walls of each channel meet the bottom surface at an angle of 105°.

Outsole 100 is molded of rubber having a durometer of 52–56 Shore A scale.

The pattern of outsole 100 is particularly suitable in uses which require frequent rotational or swiveling motion around the ball area.

In one test of the coefficient of friction of an outsole like that of FIG. 4, a quarry tile surface, typical of restaurant floors, was flooded with water or with soapy water. With regular water, the average dynamic friction coefficient was over 1.0, and with soapy water about 0.95.

Figure 6:
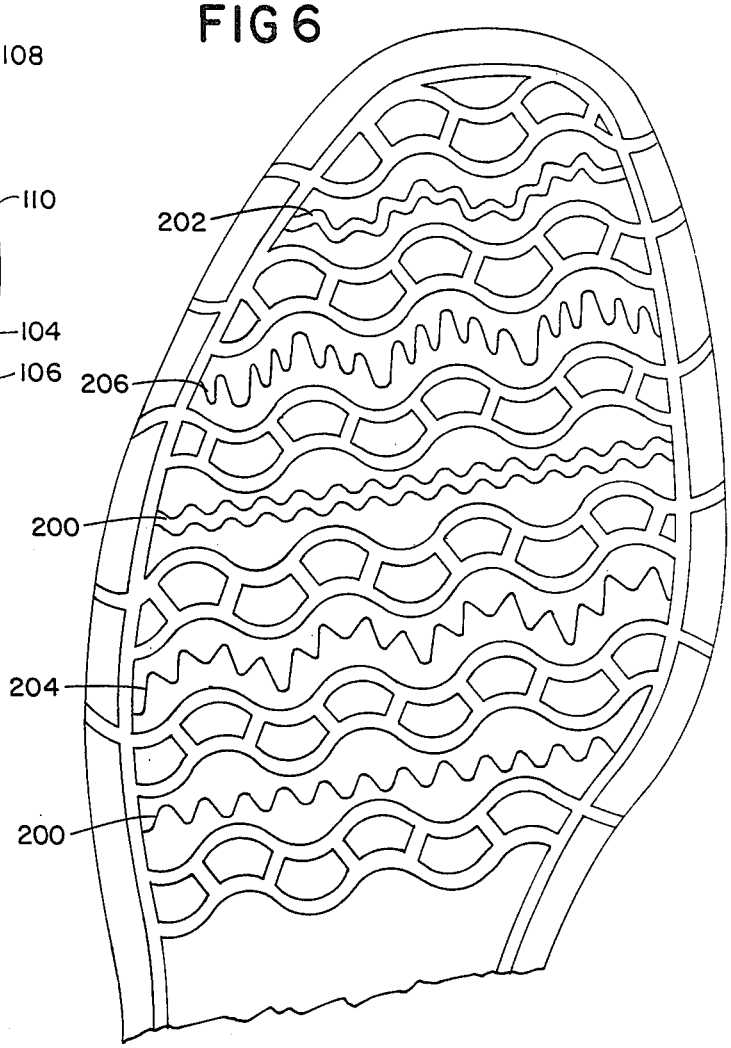

Other embodiments are within the following claims. For example, referring to FIG. 6, a variety of other siping patterns can be used. The undulations of each cut can be more frequent (200) than in FIG. 1. The number of cuts on each friction bar can be more or less than three (200). The undulations can be relatively frequent waves superimposed on less frequent waves (202, 204, 206) and the orientations of the superimposed more frequent waves can either be coordinated with the longitudinal axis (206) or with the less frequent waves on which they are superimposed (202, 204).

Other compounds (having different friction and other characteristics) and other hardness values can be used for the sole composition.

We claim:

1. A slip-resistant shoe sole comprising an outsole layer bearing a series of transverse grooves, at least some of said transverse grooves being joined by interconnection grooves, said transverse grooves and said interconnection grooves forming the perimeters of a plurality of friction elements, each adjacent pair of said transverse grooves along the length of said sole defining a transverse region said sole containing a plurality of transverse regions, said friction elements of alternate said transverse regions comprising relatively longer friction bars, and said friction elements of intervening said transverse regions comprising relatively shorter friction pads.

2. The shoe sole of claim 1 further comprising shock inserts in the ball and heel areas.

3. A slip-resistant shoe sole comprising an outsole layer having a peripheral edge and bearing a peripheral groove extending along, and in the vicinity of, the peripheral edge of said outsole layer, said outsole layer also bearing a plurality of transverse grooves extending between said peripheral groove some of said transverse grooves crossing and extending beyond said peripheral groove, some of said transverse grooves terminating at said peripheral groove.

4. The shoe sole of claim 3 wherein said transverse grooves which extend beyond said peripheral groove extend all the way to said peripheral edge.

5. The shoe sole of claim 3 wherein said peripheral groove comprises a Littleway groove.

6. The shoe sole of claim 3 wherein every other said transverse groove extends beyond said peripheral groove and each intervening said transverse groove terminates at said peripheral groove.

7. The shoe sole of claim 3 further comprising a set of concentric grooves centered on a point in the ball area.

8. The shoe sole of claim 3 further comprising a plurality of concentric grooves centered on a point in the ball area.

9. The shoe sole of claim 8 wherein some of said concentric grooves cross and extend beyond said peripheral groove and some of said concentric grooves terminate at said peripheral groove.

10. The shoe sole of claim 3 wherein at least some said transversse grooves are joined by interconnection grooves, said transverse grooves and said interconnection grooves forming the perimeter of a plurality of friction elements, and wherein each adjacent pair of said transverse grooves along the length of said sole defines a transverse region, said sole containing a plurality of transverse regions, said friction elements of some said transverse regions comprising relatively longer friction bars, and said friction elements of other said transverse regions comprising relatively shorter friction pads.

11. The shoe sole of claim 10 wherein said transverse grooves define a series of transverse regions along the length of said sole, said friction elements of alternate said transverse regions comprising relatively longer friction bars, and said friction elements of intervening said transverse regions comprising relatively shorter friction pads.

12. The shoe sole of claim 11 or 10 wherein said friction bars extend substantially all the way across said sole.

13. The shoe sole of claim 11 or 10 wherein said friction pads lie between successive said interconnection grooves.

14. The shoe sole of claim 11 or 10 wherein said regions comprising said friction pads alternate along the length of said sole with said regions comprising said friction bars.

15. The shoe sole of claim 1 or 3 further comprising siping slits.

16. The shoe sole of claim 15 wherein each said transverse groove has an undulating contour, and each said siping slit comprises a wavy slit whose undulations are the same as the undulations of an adjacent transverse groove.

17. The shoe sole of claim 15 wherein said siping slits appear only in the toe area, other areas being unsiped.

18. The shoe sole of claim 1 or 3 wherein each said transverse groove has a wiping edge where walls of said groove meet the ground, said wiping edge being contoured to include segments at various angles to a longitudinal axis of said sole.

19. The shoe sole of claim 1 or 3 wherein each said transverse groove has a continuously curving wavy contour.

20. The shoe sole of claim 14 wherein said regions comprising friction pads have a greater longitudinal extent than said regions comprising friction bars.

21. The shoe sole of claim 1, or 3 wherein each said groove has a wiping edge where its walls meet the ground and the angle between said walls and said ground is greater than 105°.

22. The shoe sole of claim 11 or 10 wherein each said bar is at least 0.375" and not more than 0.60" in the longitudinal direction and bears at least two siping slits.

23. The shoe sole of claim 1 or 10 wherein said interconnection grooves are straight.

24. A slip-resistant shoe sole comprising an outsole layer having a bottom surface defining a region of contact between the sole and the ground.

said outsole layer bearing a series of transverse channels opening onto the bottom surface to define a pattern of elongated gaps that interrupt the contact region, adjacent transverse channels being joined by interconnection channels, said transverse channels being paired such that the number of interconnection channels joining the two transverse channels of a given pair is greater than the number of interconnection channels joining one transverse channel belonging to the given pair and an adjacent transverse channel belonging to an adjacent pair, one said transverse channel in each said pair extending to the peripheral edge of said outsole layer, the distance between said transverse channels of a said given pair being greater than the width of each said gap, and wherein portions of the contact region between some adjacent pairs of elongated gaps comprise friction pads, and wherein portions of the contact region between other adjacent pairs of elongated gaps comprise friction bars which extend transversely across the sole, the friction bars bear siping slits to improve slip resistance, and the siping comprises a plurality of parallel wavy cuts only on each friction bar.

25. The shoe sole of claim 24 wherein there are three said wavy cuts per friction bar.

26. The shoe sole of claim 25 wherein said siping comprises a plurality of parallel wavy cuts only on each friction bar.

27. The sole of claim 24 or 26 wherein each friction bar is wavy and the undulations of each wavy cut are the same as the undulations of the friction bar.

28. A slip-resistant shoe sole comprising an outsole layer having a bottom surface defining a region of contact between the sole and the ground, said outsole layer bearing a series of transverse channels opening onto the bottom surface to define a pattern of elongated gaps that interrupt the contact region, adjacent transverse channels being joined by interconnection channels, said transverse channels being paired such that the number of interconnection channels joining the two transverse channels of a given pair is greater than the number of interconnection channels joining one transverse channel belonging to the given pair and an adjacent transverse channel belonging to an adjacent pair, one said transverse channel in each said pair extending to the peripheral edge of said outsole layer, the distance between said channels of a said given pair being greater than the width of each said gap, and wherein portions of the contact regions between some adjacent pairs of elongated gaps comprise friction pads, at least some of the friction pads being no shorter than 3/16" (preferably $\frac{1}{4}$") in their shortest dimension, and wherein portions of the contact regions between other adjacent pairs of elongated gaps comprise friction bars which extend transversely across the sole, and the friction bars bear siping slits to improve slip resistance.

29. A slip-resistant shoe sole comprising an outsole bearing a series of transverse grooves defining a succession of transverse regions along the length of said sole each adjacent pair of said transverse grooves along the length of said sole defining a transverse region, said sole containing a plurality of transverse regions, such that every other transverse region bears at least one friction bar and the intervening transverse regions each bear a plurality of relatively smaller friction pads, said friction bars in the toe regions bearing siping slits said friction bars in other regions bearing no slits.

* * * * *